US011725794B2

(12) United States Patent
Fischer et al.

(10) Patent No.: US 11,725,794 B2
(45) Date of Patent: Aug. 15, 2023

(54) REDUCED-TOLERANCE LIGHTING DEVICE FOR VEHICLES

(71) Applicant: HELLA GmbH & Co. KGaA, Lippstadt (DE)

(72) Inventors: Bernd Fischer, Altenbeken (DE); Benjamin Willeke, Paderborn (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/993,175

(22) Filed: Nov. 23, 2022

(65) Prior Publication Data

US 2023/0160554 A1 May 25, 2023

(30) Foreign Application Priority Data

Nov. 25, 2021 (DE) ..... 10 2021 130 929.8

(51) Int. Cl.
*F21S 43/40* (2018.01)
*F21S 43/19* (2018.01)
*F21S 43/20* (2018.01)

(52) U.S. Cl.
CPC ..... *F21S 43/195* (2018.01); *F21S 43/26* (2018.01)

(58) Field of Classification Search
CPC ..... F21S 43/195; F21S 43/26
USPC ..... 362/459
See application file for complete search history.

(56) References Cited

U.S. PATENT DOCUMENTS

| | | | | |
|---|---|---|---|---|
| 11,060,686 | B2 | 7/2021 | Barqueros et al. | |
| 2018/0283647 | A1 | 10/2018 | Hemon | |
| 2023/0001847 | A1 * | 1/2023 | Child | G01M 11/064 |

FOREIGN PATENT DOCUMENTS

| | | | | |
|---|---|---|---|---|
| AT | 518905 | A1 | 2/2018 | |
| CN | 101803049 | A * | 8/2010 | F21K 9/00 |
| DE | 102012213841 | A1 | 2/2014 | |
| DE | 102016201206 | A1 | 7/2017 | |
| EP | 2050618 | A2 * | 4/2009 | B60Q 1/10 |

* cited by examiner

*Primary Examiner* — Christopher M Raabe
(74) *Attorney, Agent, or Firm* — Muncy, Geissler, Olds & Lowe, P.C.

(57) ABSTRACT

A lighting module for use in a lighting device for a vehicle, having at least one light source unit, a first optical unit and a second optical unit as well as at least one support element, wherein the light source unit comprises at least one light source, and wherein at least the first optical unit and the second optical unit are arranged, in particular in a positionally fixed manner, on the support element, and wherein at least one first reference mark is provided on the first optical unit and at least one second reference mark on the second optical unit. In addition, the invention relates to a lighting device as well as to a method.

15 Claims, 3 Drawing Sheets

REDUCED-TOLERANCE LIGHTING DEVICE FOR VEHICLES

This nonprovisional application claims priority under 35 U.S.C. § 119(a) to German Patent Application No. 10 2021 130 929.8, which was filed in Germany on Nov. 25, 2021, and which is herein incorporated by reference.

BACKGROUND OF THE INVENTION

Field of the Invention

The present invention relates to a lighting module for use in a lighting device for a vehicle. In addition, the invention relates to a lighting device for a vehicle and to a method for producing a lighting module.

Description of the Background Art

In the production of lighting devices for vehicles (such as automobile headlamps), manufacturing and assembly tolerances lead to the necessity to keep sufficient installation space available for adjustment of the positional alignment of various components and/or assemblies relative to one another. Thus, provision can be made that optical units, for instance, which can contain light-forming elements (such as, e.g., lenses), must be positioned in a predetermined location relative to one or more light sources in order to create a desired light pattern or to achieve a desired incidence of light into one or more optical units. Provision can also be made that light sources and/or optical units must be positioned in a predefined location relative to diaphragms or other components so that light emission from predefined apertures in the diaphragms (light emission opening) is achievable with desired quality. During assembly of lighting devices or subassemblies, each assembly step or each component or each assembly is subject to specific manufacturing and/or assembly tolerances. These tolerances can propagate in the assembly process, with tolerances from subsequent or preceding work steps adding up to overall tolerances (tolerance chains), which ultimately must be taken into account during the design of corresponding lighting devices.

Accordingly, when there are individual components and/or assemblies of lighting devices for a vehicle, it is necessary to provide possibilities for adjustment of the respective positioning and/or orientation in the assembly process so that an end product of acceptable quality can always be achieved despite the respective manufacturing and/or assembly tolerances. Keeping available this possibility for adjustment of individual components and/or assemblies ultimately requires that reserves of installation space be kept available, which can have an adverse effect on the size, the weight, the material requirements, and the manageability of lighting devices for vehicles.

It is also known with regard to lighting devices for vehicles that multiple light-forming optical units must be aligned relative to one another in a defined manner in order to create a predefined overall light pattern (high beam or low beam, for example). Tolerances during assembly or relative positioning of optical units with respect to one another can ultimately lead to a relative displacement of the light fields created by the respective optical units and unintentionally change the overall light pattern created by a lighting module.

SUMMARY OF THE INVENTION

It is therefore an object of the present invention to at least partially overcome at least one of the above-described disadvantages. In particular, it is an object of the invention to at least partially break the tolerance chains in the manufacture and/or assembly of lighting devices and thus to reduce the overall tolerances and the necessary installation space of a lighting device. In addition, it is an object of the present invention to at least partially simplify the construction of a lighting device and at the same time to permit flexible design of the light pattern of a lighting device.

The above object is attained by an exemplary lighting module for use in a lighting device for a vehicle and by an exemplary lighting device, and by a method for producing a lighting module. Of course, features and details that are described in connection with the lighting module according to the invention also apply in connection with the lighting device according to the invention and/or the method according to the invention, so mutual reference is or can always be made with regard to the disclosure of the individual aspects of the invention.

Provided in an exemplary embodiment is a lighting module for use in a lighting device for a vehicle, in particular an automobile, comprising a light source unit, at least one first optical unit, in particular light-forming optical unit, and a second optical unit, in particular light-forming optical unit, as well as at least one support element, wherein the light source unit comprises at least one light source, and wherein at least the first optical unit and the second optical unit are arranged, in particular in a positionally fixed manner, on the support element. Furthermore, provision is made according to the invention that at least one first reference mark is provided on the first optical unit and at least one second reference mark on the second optical unit, wherein the first reference mark and the second reference mark are designed such that a relative positional shift between the first optical unit and the second optical unit can be determined by means of a detection of at least the first reference mark and the second reference mark.

In other words, a relative positional shift between the first reference mark and the second reference mark can be identified by means of a detection of a position and orientation of the first reference mark on the first optical unit and a detection of a position and orientation of the second reference mark on the second optical unit, wherein the relative positional shift between the first reference mark and the second reference mark is representative for the relative positional shift between the first optical unit and the second optical unit. It is possible in this connection that the relative positional shift comprises a translational and/or rotational offset between the first and the second reference mark or that the reference marks are designed such that both a translational offset and a rotational offset between the first and second reference marks can be detected.

A detected relative positional shift between the first and the second reference mark can subsequently be compared with corresponding nominal values or reference values (of a nominal positional shift) with regard to a rotational and/or translational offset between the first and second reference marks. After that, a processing position on at least one optical unit can be determined from the deviation between the detected positional shift and the nominal positional shift.

In the present case, a processing position can mean a position where the surface of a component and/or a coating arranged on a component is processed. The processing can be a laser machining and/or a conventional machining. The processing position can be present in the form of a point or a coordinate specification, whereupon the processing is carried out on at least this point, in particular in a locally circumscribed region around this point. A processing position on an optical unit can preferably be a position on the optical unit where a laser removal is to take place in an opaque coating of the optical unit. In other words, the processing position can be a position on the surface of an optical unit where an opaque coating located on the optical unit is to be removed in a locally circumscribed region around the processing position by a laser machining in order to permit an entry of light into the optical unit at this location and thus to create a light entry opening in the optical unit.

On the whole, the advantage ensues according to the invention that the positions where a local entry of light into the optical units is to take place can be defined as a function of the relative positioning of at least two optical units with respect to one another. Thus, it is possible to adjust the positions of the light entry into individual optical units or into all optical units installed in a lighting module according to the arrangement of the optical units on one or more support elements in such a manner that a superposition of the light fields created by the optical units ultimately results in the desired overall light pattern of the lighting module. If, in contrast, the positions of the light entry into the optical units are already defined prior to the positioning of the optical units on the support element, then tolerance-related deviations in the relative positioning of the optical units with respect to one another inevitably bring about a change in the overall light pattern of a lighting module. Consequently, the advantage ensues on the whole that tolerances in the positioning of multiple optical units relative to one another can be at least partially compensated for, since the tolerance chain is broken and tolerances to be taken into account during the positioning of the optical units cannot propagate further or largely cannot propagate further.

It is possible within the scope of the invention that the at least one light source unit, in particular all light source units, can be arranged in a positionally fixed manner on at least one support element. It is also possible that at least one light source of at least one light source unit is an LED.

An optical unit can comprise one or more lens elements and can have a light-forming function. With respect to its orientation within the framework of an intended use, an optical unit comprises a, in particular exactly one, light entry side (or input side) and a, in particular exactly one, light emission side (or output side). The light entry side is thus the side of an optical unit where light enters said unit in accordance with the intended use of the optical unit, and the light emission side of an optical unit is the side of an optical unit where light exits therefrom in accordance with the intended use of the optical unit. The light rays incident on the light entry side are altered in their direction, at least in part, by the optical unit so that at least some of the light rays incident on the light entry side in the optical unit have a direction at the light emission side that is altered in comparison with the light entry side. For this purpose, an optical unit comprises at least one lens element or multiple lens elements, in particular identically designed lens elements. The respective light entry sides of the lens elements form the light entry side of the optical unit and the respective light emission sides of the lens elements form the light emission side of the optical unit.

In the present case, a positionally fixed arrangement can mean that relative motion between the component concerned (e.g., an optical unit) and the support element is no longer possible after a positionally fixed assembly or arrangement. Following the positionally fixed arrangement, therefore, the component concerned can only be moved indirectly by means of a motion of the support element, wherein a relative motion between the component and the support element, as well as between the component and other components (e.g., other optical units) arranged in a positionally fixed manner on the support element, is precluded. This results in the advantage that an unintentional displacement of optical units and a resultant alteration of the light pattern of a lighting module can be avoided.

It is also possible that a lighting module according to the invention comprises three, in particular four, preferably five, or preferentially more than five optical units, in particular light-forming optical units, wherein at least one reference mark is provided on each of the optical units and the optical units are arranged, in particular in a positionally fixed manner, on at least one, in particular on exactly one, support element so that a relative displacement of the optical units with respect to one another is prevented. In this context it is possible that a relative positional shift between all optical units can be determined by means of a detection of at least one reference mark of each optical unit. Consequently, at least one processing position on at least one optical unit can be identified on the basis of the identified positional shifts.

It is furthermore possible that at least two optical units, in particular all optical units, of a lighting module are arranged in a common plane, preferably in relation to a respective light entry surface of the optical units. In other words, provision can be made that the light entry surfaces of at least two optical units of a lighting module have no offset in relation to a main direction of emission of the lighting module. This results in the advantage of a simpler determination of the relative positional shift between individual optical units. A relative positional shift between two optical units can thus be described by a translational offset in the common plane as well as a rotational offset in the common plane, wherein the respective axes of rotation of the reference marks are perpendicular to the common plane, in particular in relation to the rotational offset.

The support element can be designed with several parts. In this case, the individual parts of the support element preferably can be connected to one another in such a manner that no relative motion of individual parts of the support element with respect to one another is possible. In other words, provision can be made that the support element forms a rigid structure on which other components, in particular one or more optical units, can be installed in a positionally fixed manner. At least sections of the support element can be designed as a profile, a frame, or a strut. It is also possible that the support element is designed as a monolithic component, in particular of uniform material.

Provision can be made within the scope of the invention that at least one optical unit, in particular all optical units, can be connected to at least one support element in an interlocking and/or frictional and/or reversible manner. In other words, provision can be made that at least one optical unit is connected to at least one support element in such a manner that the connection between optical unit and support element preferably can be released nondestructively. In particular, the connection between at least one optical unit and at least one support element can be formed by a screwed connection or a clipped connection. This produces the advantage that faulty or defective optical units can be replaced easily and flexibly without damaging other components.

At least one reference mark of at least one optical unit can be designed such that it can be detected through an optical and/or tactile measurement of the optical unit. In this context, it is possible that at least one reference mark of at least one optical unit is at least partially raised in comparison with the surface of the optical unit and/or is at least partially recessed into the surface, which is to say forms an indentation. It is also possible that at least one reference mark of at least one optical unit is colored, at least in sections, in such a manner that it can be visually distinguished from the surface of the optical unit. It is also possible that a reference mark has, at least in sections, reflective behavior that differs from the surface of the optical unit surrounding the reference mark. This achieves the advantage that a reference mark of an optical unit can be reliably and unambiguously detected within the framework of a preferably automated optical and/or tactile measurement process.

It is also possible that all reference marks on an optical unit and/or all reference marks of all optical units can be implemented identically. This produces the advantage that a standardized detection of reference marks within the framework of a preferably automated measurement of one or more optical units is simplified.

The location of at least one reference mark of an optical unit can be correlated with the alignment of at least one optical axis of the optical unit or with at least one optical axis of a lens element of the optical unit. In other words, owing to the detection of the position and/or orientation of the reference mark, it is possible that the position and/or orientation of at least one optical axis of the optical unit can be derived directly or that the reference mark has a defined location and orientation to at least one optical axis. This produces the advantage that the orientation of optical axes of multiple optical units with respect to one another can be identified on the basis of the relative positional shift between the reference marks of individual optical units, and the determination of necessary processing positions on individual optical units is simplified on this basis.

Provision can be made within the scope of the invention that at least one lens element of at least one optical unit has, preferably on a light emission side, a surface that is convex at least in sections, wherein the focal point of the convex surface is located in the lens element. This achieves the advantage that the lens element forms an image, not of a light source, if applicable arranged behind the lens element, but instead of a light entry opening (for example, an aperture in an opaque coating) provided in the lens element or in the optical unit.

It is furthermore possible that at least one lens element of at least one optical unit is a rotationally symmetric, preferably spherical or aspheric, collimating lens element. This achieves the advantage that the light rays from a light source incident on the optical unit are aligned at least partially parallel along a main direction of emission of the lighting module, and a light forming (for example by a projection module), possibly downstream, is simplified. A rotationally symmetric design of the lens produces the advantage of a symmetric light pattern of the lens.

It is likewise possible that at least one lens element of an optical unit is not rotationally symmetric in design. This produces the advantage that at least one edge of a light entry opening on the optical unit (for example, an aperture in an opaque coating) can be or is imaged in a blurred fashion by the lens element.

At least one lens element of at least one optical unit can be made, at least in sections, of glass and/or a polymer and/or a silicone. With respect to the use of glass, the advantage ensues of a high resistance to surface damage (such as scratches). With respect to the use of a polymer, the advantage ensues of especially cost-effective manufacture. With respect to the use of a silicone, the advantage ensues of an especially low weight.

At least one optical unit can comprise at least a first and a second lens element. It is possible here that at least the first and the second lens element, in particular all lens elements, of an optical unit are identical in design. This produces the advantage of uniform light forming with respect to individual light segments created by an optical unit.

It is also possible that at least two, preferably all, lens elements of at least one optical unit can be connected to one another in an interlocking and/or irreversible manner, at least in sections, and/or form a monolithic component, in particular of uniform material at least in sections. This achieves the advantage that multiple lens elements of an optical unit are combined into a common assembly and the susceptibility to faults with regard to the positioning of individual lens elements in an optical unit is reduced and handling of the lens elements is also simplified.

It is likewise possible that at least one lens element of at least one optical unit, in particular multiple or all lens elements of at least one optical unit, can form a light entry surface of the optical unit that is planar at least in sections, preferably completely. Provision can also be made according to the invention that at least one reference mark on at least one optical unit is arranged on a light entry side, in particular a planar light entry side. In the case when processing of the light entry side of an optical unit is desired, this produces the advantage that the optical unit can be processed immediately and without changing its positioning after the detection of the reference mark or the detection of additional reference marks of other optical units, resulting in an efficient manufacturing or assembly process.

In addition, provision can be made that an opaque coating can be arranged, at least in sections, on at least one optical unit on a light entry side, in particular planar light entry side. In this context, it is possible that the opaque coating is vapor-deposited on the light entry side of the optical unit. In addition, it is possible that at least one, in particular multiple, light entry openings or apertures are provided in an opaque coating of at least one optical unit, in particular of all optical units, in order to permit an entry of light, in particular locally circumscribed entry, into the optical unit, in particular into at least one lens element of the optical unit. This achieves the advantage that the local entry of light into an optical unit is defined by the deliberate arrangement of light entry openings or apertures in the opaque coating and that the light pattern created by the optical unit can be influenced as a result. The positions of the light entry openings can be adjusted as a function of the relative positional shifts between at least two optical units in order to compensate for tolerances in the positioning of the optical units in this case.

It is possible within the scope of the invention that the light source unit comprises at least one printed circuit board and/or at least one heat sink. In this context, it is possible that at least one light source, in particular multiple light sources, preferably LEDs, are arranged on a printed circuit board, wherein an integral connection, in particular a soldered joint, preferably is formed between the light sources and the printed circuit board. The use of an LED brings about the advantage of energy-efficient operation of the lighting module. In addition, it is possible that the heat sink is arranged on the printed circuit board. The use of a heat sink brings about the advantage that the heat emitted by the light sources can be removed efficiently. At least one cooling fin can be formed on the heat sink. In this way, the efficiency of the heat removal can be increased by an enlargement of the surface. Provision can be made that the light sources and the heat sink are arranged on opposite sides of the printed circuit board. It is also possible within the scope of the invention that one of the printed circuit boards has at least one through-connection, which functions as a thermal bridge, in particular in the immediate vicinity of at least one light source or under at least one light source. In this way, the effectiveness of the heat transport from the light sources to the heat sink can be increased.

It is furthermore possible that at least one optical unit and at least one light source or at least one light source unit are positioned relative to one another in such a manner that at least one light source is arranged at a light entry opening of an optical unit. In the present case, arrangement at a light entry opening or an aperture can mean that the projected area of an LED overlaps at least partially, in particular substantially, preferably fully, with the area of the light entry opening or of the aperture with respect to a direction of view in the main direction of emission of the lighting module. This produces the advantage that a majority of the light emitted by a light source is radiated into a light entry opening of the optical unit.

Provision can be made that at least one edge of at least one light entry opening or aperture in the opaque coating of an optical unit is located at least partially, in particular fully, outside the projected area of a light source arranged at the aperture. This produces the advantage that a tailing off of the light distribution with respect to this edge can be created through aberrations of the optical unit or of at least one lens element of the optical unit with respect to light rays distant from the axis.

Provision can additionally be made within the scope of the invention that at least one light source has a distance between 0 mm and 10 mm, preferably between 0 mm and 8 mm, especially preferably between 0 mm and 5 mm, from a light entry surface or light entry opening of an optical unit with respect to a main direction of emission of a lighting module. In the case of a distance of 0 mm, the light source touches the surface of the optical unit. As a result, the effect of a light distribution that tails off with respect to individual edges of a light entry opening can likewise be achieved or enhanced.

Provision can also be made according to the invention that at least one light source, in particular exactly one light source, is arranged at each light entry opening or aperture in an opaque coating of at least one optical unit, in particular of all optical units.

It is possible within the scope of the invention that at least one projection module is provided, wherein the projection module comprises at least one lens element, and wherein the projection module is arranged opposite a light emission side of at least one optical unit. It is further possible that at least one lens element of the projection module is designed as a vertical or horizontal cylindrical lens. The use of an additional projection module brings about the advantage of flexible design of the light pattern created by a lighting module, for instance on a road, as well as the option of varying the size of the light segment created.

It is also possible within the scope of the invention that the projection module comprises at least one first lens element with a negative focal length and a second lens element with a positive focal length, wherein particularly the first lens element is arranged opposite the second lens element, at least in sections, and preferably the first lens element and the second lens element are positioned relative to one another in such a manner that the focal point of the first lens element coincides with the focal point of the second lens element. Such a structure of the projection module brings about the advantage that the size of a segment illuminated by a lighting module, for instance on a road, is individually adjustable as a function of the size ratio of the focal lengths of the opposing lenses.

Furthermore, the above object is attained by a lighting device for a vehicle, wherein the lighting device comprises at least one lighting module according to the invention. Provision can be made that different light modules of the lighting device each comprise at least one lighting module according to the invention. Thus, provision can be made that the lighting device contains a high beam light module and/or a low beam light module and/or a vicinity light module, and at least one of the said light modules comprises a lighting module according to the invention.

Furthermore, the above object is attained by a method for producing a lighting module for use in a lighting device for a vehicle, comprising at least one light source unit, at least one first optical unit and a second optical unit as well as a support element, wherein the light source unit comprises at least one light source. Furthermore, provision is made according to the invention that at least one first reference mark is provided on the first optical unit and a second reference mark is provided on the second optical unit and that at least the following steps are executed, preferably in the specified order, within the framework of the method according to the invention: attaching the first optical unit to the support element; attaching the second optical unit to the support element; detecting the first reference mark on the first optical unit; detecting the second reference mark on the second optical unit; determining a relative positional shift between the first reference mark and the second reference mark; determining at least one processing position on at least one optical unit; processing at least one optical unit at least at one processing position.

It is possible within the scope of the invention that at least individual steps are repeated and/or are carried out simultaneously. In particular, it is possible that the detecting of multiple reference marks on one or more optical units takes place simultaneously, or at least two detection processes, in particular all detection processes, at least partially overlap in time. The method according to the invention brings about the same advantages as have already been described with respect to the lighting module according to the invention.

Provision can be made that the detecting of a reference mark is accomplished through an optical and/or tactile measurement of at least one optical unit. Provision can also be made according to the invention that a laser machining of at least one optical unit takes place in step g) of the method according to the invention. The laser machining can include, in particular, of removing an opaque coating on a light entry side of an optical unit in a locally circumscribed region in order to thus implement a light entry opening in the optical unit.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
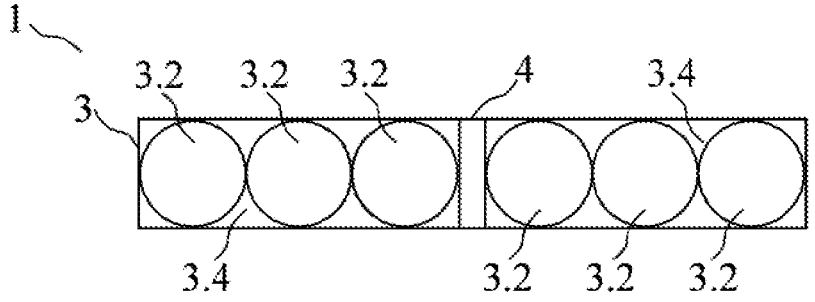
FIG. 1 is a schematic front view of a lighting module according to the invention.

FIG. 1 shows a schematic front view of a lighting module 1 according to the invention. The direction of view is opposite the main direction of emission H of the lighting module and directed toward the light emission side 3.4 of the optical units 3. The lighting module comprises a first optical unit 3 and a second optical unit 3, wherein the first optical unit 3 as well as the second optical unit 3 each include three lens elements 3.2. Both optical units 3 are arranged on a support element 4 in a positionally fixed manner. In the present case, the support element 4 is designed as a frame, in particular full-perimeter frame. The lens elements 3.2 are rotationally symmetric in design, at least in sections. The lens elements 3.2 of the first optical unit 3 and the lens elements 3.2 of the second optical unit 3 are identical and are designed as aspheric collimating lens elements. The lens elements 3.2 are integrally connected, at least in sections, and form a monolithic component.

Figure 2:
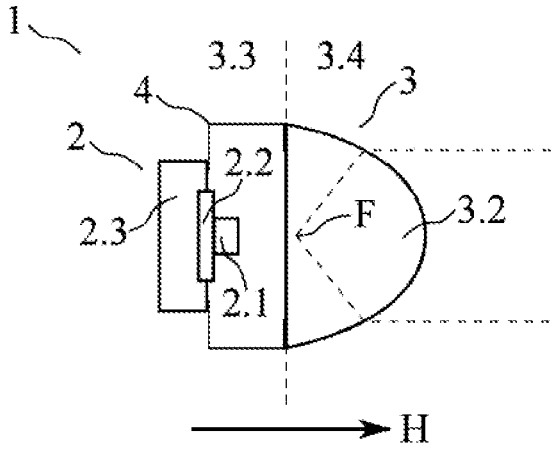
FIG. 2 is a schematic side view of a lighting module according to the invention.

FIG. 2 shows a schematic side view of a lighting module 1 according to the invention. The direction of view is orthogonal to the main direction of emission H of the lighting module 1. The optical unit 3 has a light entry side 3.3 and a light emission side 3.4, wherein the light entry side 3.3 is arranged ahead of the light emission side 3.4 with respect to a main direction of emission H of the lighting module 1. The lens elements 3.2 have, on the light emission side 3.4, a surface that is convex at least in sections, wherein the focal point F of the convex surface is located in the lens element 3.2. Arranged opposite the light entry side 3.3 of the optical unit 3 is a light source unit 2, which comprises a light source 2.1, a printed circuit board 2.2, as well as a heat sink 2.3. The heat sink 2.3 is arranged on the printed circuit board 2.2 on the side of the printed circuit board 2.2 facing away from the lens element 3.2 and has multiple cooling fins (not shown) for efficient heat removal. The light source 2.1 in the present case is designed as an LED and is arranged on the printed circuit board 2.2 on the side of the printed circuit board 2.2 facing toward the lens element 3.2.

The lens elements 3.2 of the optical unit 3 each have, on the light emission side 3.4, a surface that is convex at least in sections, wherein the focal point F of the respective convex surface is located in the respective lens element 3.2. In the present case, the lens elements 3.2 are designed as rotationally symmetric collimating lens elements. The side of the lens elements 3.2 facing the light source unit 2 is planar in design, producing a planar light entry surface 3.3 of the optical unit 3.

Figure 3:
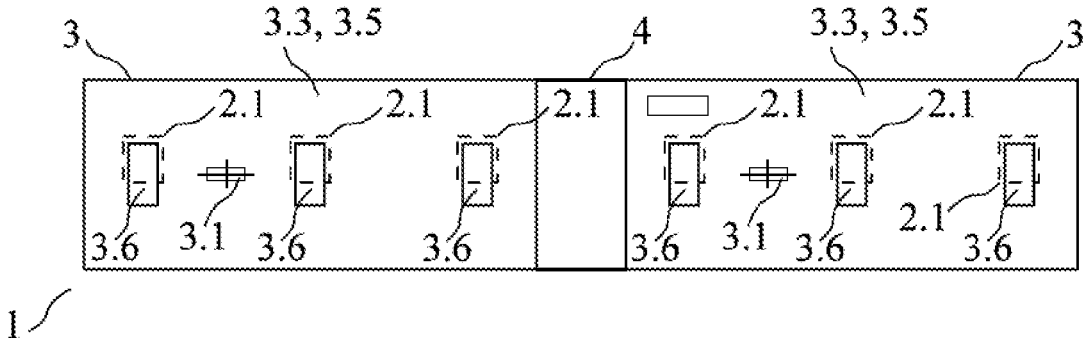
FIG. 3 is a schematic rear view of a lighting module according to the invention.

FIG. 3 shows a schematic rear view of a lighting module 1 according to the invention. The direction of view is along the main direction of emission H of the lighting module and directed toward the light entry side 3.3 of the optical units 3. The light emission side 3.4 of the optical units 3 is provided with an opaque coating 3.5, wherein multiple light entry openings 3.6 are provided in the opaque coating 3.5 in each case. In other words, multiple apertures, through which light can enter into the optical units 3, are provided in the opaque coating 3.5. On each of the two optical units 3, a reference mark 3.1 is arranged on the light entry side 3.3 of the optical units 3, wherein the reference marks 3.1 are identical in design on both optical units 3. Arranged on each of the light entry openings 3.6 is a light source 2.1, wherein the light sources 2.1 are represented by dashed lines for reasons of clarity. The dashed lines correspond to the area of the light sources 2.1 projected in the main direction of emission. The projected areas of the light sources 2.1 overlap at least partially with the respective light entry openings 3.6. Provision is made in the present case that at least one edge of the respective light emission openings is located outside the projected area of the associated light source 2.1 in each case. The light entry sides 3.3 of the optical units 3 are planar in design and are arranged in a common plane that is orthogonal to the main direction of emission H.

Figure 4:
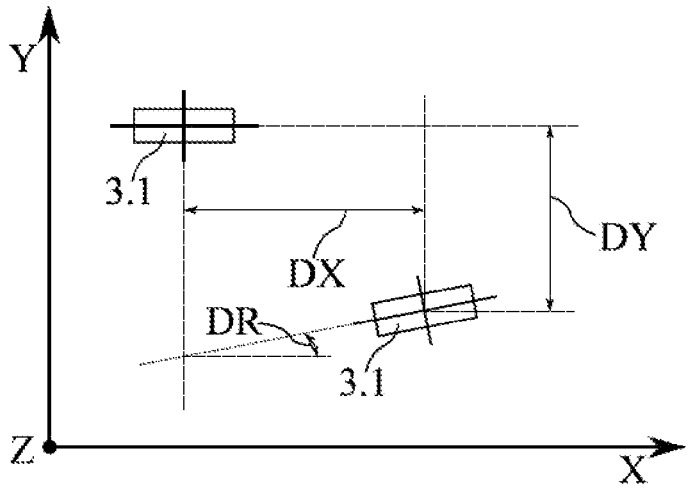
FIG. 4 shows schematically a relative positional shift between two reference marks in a Cartesian coordinate system.

FIG. 4 schematically shows a relative positional shift between two reference marks in a Cartesian coordinate system with the Cartesian coordinate directions X, Y, and Z. Each reference mark 3.1 is arranged on one optical unit, wherein the optical units are not shown for reasons of clarity. The light entry sides 3.3 of the optical units 3 that are not shown are planar in design and are arranged in the XY plane. The reference marks 3.1 are arranged on the respective light entry sides 3.3 of the optical units 3, and thus are likewise located in the same plane. A relative positional shift between the first and second positional shifts can be identified through detection of the location and orientation or rotation of the two reference marks in the common plane. The relative positional shift in the present case has a translational offset DX in the X direction, a translational offset DY in the Y direction, and a rotational offset DR (can be specified in angular degrees, for example) between the reference marks. The rotation of a reference mark 3.1 relates in the present case to a rotation about an axis of rotation oriented perpendicular to the XY plane (in the Z direction). The identified relative positional shift between at least two reference marks 3.1 can now be compared with a nominal value for the positional shift. On the basis of the deviation between the actual positional shift and the nominal positional shift, at least one processing position on at least one optical unit can subsequently be identified. It is thus possible for, e.g., light entry openings on at least one optical unit 3 to be positioned as a function of the relative positional shift between at least two optical units 3 in such a manner that a desired light pattern results from the interaction of all optical units 3.

Figure 5:
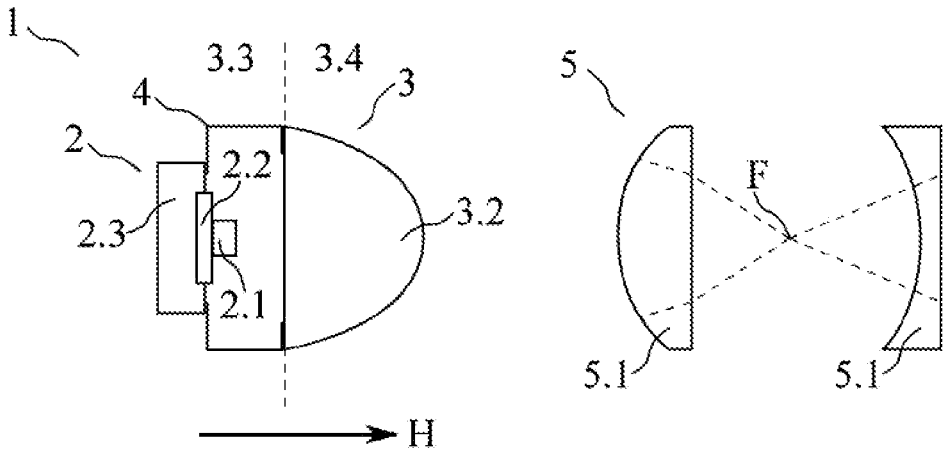
FIG. 5 is a schematic side view of a lighting module according to the invention.

FIG. 5 shows a schematic side view of an exemplary embodiment of a lighting module 1 according to the invention. The direction of view is orthogonal to the main direction of emission H of the lighting module 1. The lighting module additionally comprises a projection module 5, wherein the projection module comprises a first lens element 5.1 and a second lens element 5.1. Here, the lens element 5.1 that is arranged closer to the optical unit 3 with respect to the main direction of emission H has a positive focal length, and the lens element 5.1 that is arranged further from the optical unit 3 with respect to the main direction of emission H has a negative focal length. The two lens elements 5.1 are arranged opposite one another and are positioned relative to one another such that the focal point F of the first lens element 5.1 coincides with the focal point F of the second lens element 5.1.

Figure 6:
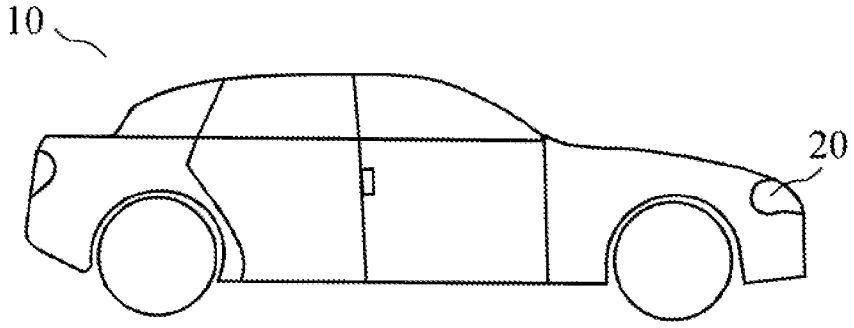
FIG. 6 is a schematic view of a vehicle with a lighting device according to the invention.

FIG. 6 shows a vehicle with a lighting device (20) according to the invention, wherein the lighting device (20) is a headlamp of the vehicle, and the lighting device comprises at least one lighting module 1 according to the invention.

Figure 7:
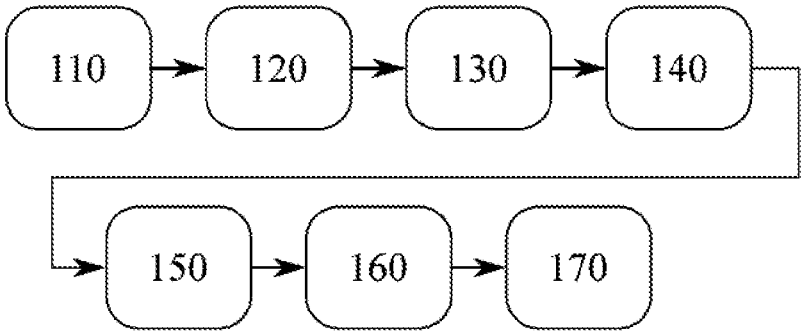
FIG. 7 shows a flowchart of the method.

FIG. 7 shows a method 100 according to the invention for producing a lighting module 1 for use in a lighting device for a vehicle 10, comprising at least one light source unit 2, a first optical unit 3 and a second optical unit 3 as well as at least one support element 4, wherein the light source unit 2 comprises at least one light source 2.1 and wherein at least one first reference mark 3.1 is provided on the first optical unit 3 and at least one second reference mark 3.1 is provided on the second optical unit 3 and wherein at least the following steps are executed, for example in the specified order: Attaching 110 the first optical unit 3 to the support element 4; Attaching 120 the second optical unit 3 to the support element 4; Detecting 130 the first reference mark 3.1 on the first optical unit 3; Detecting 140 the second reference mark 3.1 on the second optical unit 3; Determining 150 a relative positional shift between the first reference mark 3.1 and the second reference mark 3.1; Determining 160 at least one processing position on at least one optical unit 3; and Processing 170 at least one optical unit 3 at least at one processing position.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A lighting module for a lighting device for a vehicle, the lighting module comprising:

at least one light source unit comprising at least one light source;

a first optical unit;

a second optical unit; and at least one support element, wherein at least the first optical unit and the second optical unit are arranged in a positionally fixed manner on the support element, wherein at least one first reference mark is provided on the first optical unit and at least one second reference mark on the second optical unit, wherein the first reference mark and the second reference mark are designed such that a relative positional shift between the first optical unit, and wherein the second optical unit is determined by a detection of the first reference mark and the second reference mark.

2. The lighting module according to claim 1, wherein at least one reference mark of at least one optical unit is designed such that it is detected through an optical and/or tactile measurement of the optical unit and/or wherein the location of at least one reference mark of at least one optical unit is correlated with the alignment of at least one optical axis of the optical unit.

3. The lighting module according to claim 1, wherein at least one lens element of at least one optical unit has on a light emission side, a surface that is convex at least in sections, and wherein the focal point of the convex surface is located in the lens element.

4. The lighting module according to claim 1, wherein at least one lens element of at least one optical unit is a rotationally symmetric, spherical, or aspheric, collimating lens element.

5. The lighting module according to claim 1, wherein at least two lens elements of at least one optical unit are integrally connected to one another, at least in sections, and/or form a monolithic component of uniform material at least in sections.

6. The lighting module according to claim 1, wherein at least one reference mark on at least one optical unit is arranged on a light entry side or a planar light entry side.

7. The lighting module according to claim 1, wherein an opaque coating is arranged, at least in sections, on at least one optical unit on a light entry side or a planar light entry side.

8. The lighting module according to claim 1, wherein at least one light entry opening is provided in an opaque coating on at least one optical unit in order to permit an entry of light, in particular locally circumscribed entry, into the optical unit, preferably into at least one lens element of the optical unit.

9. The lighting module according to claim 1, wherein at least one projection module is provided, wherein the projection module comprises at least one lens element, and wherein the projection module is arranged, at least in sections, opposite a light emission side of at least one optical unit.

10. The lighting module according to claim 9, wherein at least one lens element of the projection module is a vertical or horizontal cylindrical lens.

11. The lighting module according to claim 9, wherein the projection module comprises at least one first lens element with a negative focal length and a second lens element with a positive focal length, wherein the first lens element is arranged opposite the second lens element, at least in sections, and wherein the first lens element and the second lens element are positioned relative to one another such that the focal point of the first lens element coincides with the focal point of the second lens element.

12. A lighting device, in particular headlamp, for a vehicle, comprising at least one lighting module according to claim 1.

13. A method for producing a lighting module for a lighting device for a vehicle, the lighting module comprising at least one light source unit, a first optical unit, a second optical unit, and at least one support element, the light source unit comprising at least one light source, at least one first reference mark being provided on the first optical unit and at least one second reference mark being provided on the second optical unit, the method comprising:

attaching the first optical unit to the support element;

attaching the second optical unit to the support element;

detecting the first reference mark on the first optical unit;

detecting the second reference mark on the second optical unit;

determining a relative positional shift between the first reference mark and the second reference mark;

determining at least one processing position on at least one optical unit; and processing at least one optical unit at least at one processing position.

14. The method according to claim 13, wherein the detecting of at least one reference mark is accomplished through an optical and/or tactile measurement of at least one optical unit.

15. The method according to claim 13, wherein a laser machining of at least one optical unit takes place during the processing step.

* * * * *